US012426648B2

(12) United States Patent
Morris

(10) Patent No.: US 12,426,648 B2
(45) Date of Patent: Sep. 30, 2025

(54) GARMENT HAVING A MANIPULABLE CROTCH AREA

(71) Applicant: Aurora Outdoor Outfits, LLC, Chapel Hill, NC (US)

(72) Inventor: Beatriz Blanco Morris, Chapel Hill, NC (US)

(73) Assignee: Aurora Outdoor Outfits, LLC, Chapel Hill, NC (US)

( * ) Notice: Subject to any disclaimer, the term of this patent is extended or adjusted under 35 U.S.C. 154(b) by 43 days.

(21) Appl. No.: 18/332,931

(22) Filed: Jun. 12, 2023

(65) Prior Publication Data

US 2023/0404179 A1 Dec. 21, 2023

Related U.S. Application Data

(60) Provisional application No. 63/352,716, filed on Jun. 16, 2022.

(51) Int. Cl.
*A41D 1/06* (2006.01)
*A41B 9/00* (2006.01)
*A41B 9/02* (2006.01)

(52) U.S. Cl.
CPC ..... *A41D 1/065* (2013.01); *A41B 9/004* (2013.01); *A41B 9/005* (2013.01); *A41B 9/023* (2013.01); *A41B 9/026* (2013.01)

(58) Field of Classification Search
CPC ..... A41D 1/065; A41B 9/004; A41B 9/005; A41B 9/023; A41B 9/026
See application file for complete search history.

(56) References Cited

U.S. PATENT DOCUMENTS 1,477,187 A * 12/1923 Rayne ..... A61F 5/40 602/73
2,476,585 A * 7/1949 Cohen ..... A41C 1/02 2/408
2,522,009 A * 9/1950 Wohlman ..... A41C 1/003 2/408
3,224,448 A * 12/1965 Diebold ..... A41C 1/003 2/408

(Continued)

OTHER PUBLICATIONS

"Chickfly—Another Way to Open Your Pants," https://chickfly.com; Downloaded from the Internet Jun. 12, 2023, 5 pgs.

*Primary Examiner* — Khaled Annis
(74) *Attorney, Agent, or Firm* — Stanek Lemon Crouse & Meeks, PA

(57) ABSTRACT

The present disclosure relates to a versatile garment designed to provide easy access to genitalia without requiring removal. The garment features a body portion, leg portions, and a manipulable crotch area defined by manipulable overlapping constituents. In its unmanipulated state, the manipulable crotch area maintains a closed configuration, facilitating a secure and comfortable fit. By separating the overlapping constituents, an opening is created, aligned with the wearer's genitalia. This opening enables convenient urination without the need to remove or significantly lower the garment. The garment is suitable for use by individuals of any gender, gender role, gender identity, and/or gender expression, including female or transgender female wearers. With its functional design and inclusive features, the disclosed garment offers enhanced convenience and promotes personal hygiene for a diverse range of individuals.

13 Claims, 18 Drawing Sheets

(56) References Cited

U.S. PATENT DOCUMENTS 3,486,507 A * 12/1969 Arnold ..... A41B 9/04 2/408
4,270,539 A * 6/1981 Frosch ..... A61F 5/455 604/347
4,301,550 A * 11/1981 Carver ..... A41B 9/005 2/408
4,553,968 A * 11/1985 Komis ..... A41B 9/023 604/351
4,815,151 A * 3/1989 Ball ..... A61F 5/4556 4/144.1
5,086,519 A * 2/1992 Rokasky ..... A41B 9/04 2/408
5,535,757 A * 7/1996 Fleming, Jr. ..... A61F 6/04 128/842
5,984,910 A * 11/1999 Berke ..... A41B 9/023 128/854
6,113,582 A * 9/2000 Dwork ..... A61F 5/453 604/351
6,209,143 B1 * 4/2001 Hancock ..... A41B 9/04 2/408
7,024,703 B1 * 4/2006 Della Ratta ..... A41B 9/023 2/403
7,100,214 B1 * 9/2006 Murray ..... A41C 1/003 2/408
8,555,422 B2 * 10/2013 Steele ..... A41B 9/023 2/403
10,238,530 B2 * 3/2019 Mahalingam ..... A41D 1/065
10,555,564 B2 * 2/2020 Brady ..... A41B 9/005
11,583,434 B1 * 2/2023 Cimino ..... A61F 5/4556
11,957,183 B1 * 4/2024 Bleiler-Sickels ..... A41B 9/14
2004/0231034 A1 * 11/2004 Cym ..... A41B 9/023 2/403
2009/0131916 A1 * 5/2009 Chiu ..... A61F 5/4556 604/544
2010/0269243 A1 * 10/2010 Paree ..... A41B 9/005 2/243.1
2014/0053322 A1 * 2/2014 Zamler ..... A41B 9/04 2/407
2014/0196193 A1 * 7/2014 Namy ..... A41D 1/065 2/227
2014/0317821 A1 * 10/2014 Berns ..... A61F 6/04 2/69
2015/0209647 A1 * 7/2015 MacFarland ..... A41D 13/0506 2/466
2016/0143769 A1 * 5/2016 Mahalingam ..... A61F 5/4408 2/243.1
2018/0007979 A1 * 1/2018 Brady ..... A41D 1/22
2019/0307178 A1 * 10/2019 Polynski ..... A41B 9/026
2020/0068961 A1 * 3/2020 Cohen ..... A41B 9/04
2020/0397062 A1 * 12/2020 Tautiva ..... A41B 9/026
2022/0071799 A1 * 3/2022 Moten ..... A61F 6/04
2022/0133527 A1 * 5/2022 Brown ..... A41B 9/005 128/844
2023/0404179 A1 * 12/2023 Morris ..... A41B 9/026

* cited by examiner

GARMENT HAVING A MANIPULABLE CROTCH AREA

RELATED APPLICATIONS

This application claims priority benefit to U.S. App. Ser. No. 63/352,716, filed Jun. 16, 2022, entitled "Garment Having a Crotch Opening," which is hereby incorporated by reference in its entirety.

FIELD

The present inventive concept relates generally to clothing and, more particularly, to garments having a manipulable crotch area allowing the wearer to urinate while fully clothed without the use of snaps, buttons, zippers, ties, or other fasteners to maintain closure of the opening when closure is desired.

BACKGROUND

Urinary elimination is a fundamental bodily function that individuals need to perform multiple times throughout the day. However, conventional urination methods can present specific difficulties for individuals who identify as female. In comparison to those who identify as male, individuals who identify as female often encounter challenges that involve heightened bodily exposure and limited opportunities for discreet and convenient urination. These challenges become especially pronounced in situations where immediate access to a restroom is not readily available.

SUMMARY

The present disclosure relates to a versatile garment designed to provide easy access to genitalia without requiring removal. The garment features a body portion, leg portions, and a manipulable crotch area defined by manipulable overlapping constituents. In its unmanipulated state, the manipulable crotch area maintains a closed configuration, facilitating a secure and comfortable fit. By separating the overlapping constituents, an opening is created, aligned with the wearer's genitalia. This opening enables convenient urination without the need to remove or significantly lower the garment. The garment is suitable for use by individuals of any gender, gender role, gender identity, and/or gender expression, including female or transgender female wearers. With its functional design and inclusive features, the disclosed garment offers enhanced convenience and promotes personal hygiene for a diverse range of individuals.

In some embodiments, a garment is disclosed for facilitating access to genitalia of a wearer. The garment can include a body portion, two leg portions, and a manipulable crotch area. The body portion can be adapted to be worn on the torso and lower body of the wearer. The two leg portions can extend from the body portion. Each leg portion can accommodate a leg of the wearer. The manipulable crotch area can be integrally formed between the two leg portions. The manipulable crotch area can be defined by manipulable overlapping constituents. The manipulable crotch area, in an unmanipulated state, can be maintained in a closed configuration by an interface of the overlapping constituents. The closed configuration can be alterable to an open configuration through separation of the overlapping constituents. The open configuration can be characterized by an opening aligned with the genitalia of the wearer.

The garment of the preceding paragraph can include one or more of the following features described in this paragraph. The manipulable crotch area can include a base layer defining an aperture. The overlapping constituents can include a second layer and a third layer. The second layer can be positioned to partially cover the aperture of the base layer and the third layer can be positioned to overlap with the second layer and to cover at least a remaining exposed portion of the aperture, such that the second and third layers in the unmanipulated state collectively cover an entirety of the aperture and are independently manipulable to expose the aperture of the base layer. Each of the second layer and the third layer individually can cover at least 50%, 60%, 70%, 75%, 80%, 85%, 90% of more (+/−about 5%) of the aperture of the base layer when in the unmanipulated state. The second layer and the third layer can overlap by at least 50% of their total surface area when in the closed configuration. The aperture of the base layer can have a geometric shape selected from the group consisting of circular, elliptical, square, rectangle, triangle, and pentagon.

The garment of any of the preceding paragraphs can include one or more of the following features described in this paragraph. The overlapping constituents can be positioned in a lower portion of the manipulable crotch area to accommodate and align with a urethral opening of female or transgender female wearers for facilitated urination. The manipulable crotch area, when in the open configuration, can allow for direct access to the genitalia for urination without removal or significant lowering of the garment. The overlapping constituents can include first and second overlapping panels, the first and second overlapping panels being arranged such that manipulation in a lateral or downward direction results in creation of the opening. The overlapping constituents can be shaped and arranged to form a seal around a urination device when the manipulable crotch area is in the open configuration, thereby providing a secure interface between the garment and the urination device. The urination device can be a urination funnel that interfaces with the opening when the manipulable crotch area is in the open configuration.

The garment of any of the preceding paragraphs can include one or more of the following features described in this paragraph. The opening can be located at or near a lowermost portion of the manipulable crotch area when the garment is worn. The manipulable crotch area can be located at a position corresponding to an anatomical location of a urethra of the wearer when the garment is worn. Each leg portion can extend contiguously from the body portion. The garment can be selected from the group consisting of pants, jeans, jeggings, leggings, tights, hosiery, athletic pants, sweatpants, leisure pants, yoga pants, one-piece suits, bibs, pajama pants, medical scrub pants, shorts, running shorts, skorts, swimwear. The garment can be suitable for use by human subjects of any gender, gender role, gender identity and/or gender expression. The garment can be configured to be used with or without an undergarment. The overlapping constituents of the manipulable crotch area can be designed in a way that the interface is located towards a lower part of the manipulable crotch area when worn by the wearer.

In some embodiments, a system for facilitating urination is disclosed. The system can include a garment and a urination device. The garment can include a body portion, two leg portions, and a manipulable crotch area. The body portion can be adapted to be worn on the torso and the lower body of the wearer. The two leg portions can extend from the body portion. Each leg portion can accommodate a leg of the wearer. The manipulable crotch area can be integrally formed between the two leg portions. The manipulable crotch area can be defined by manipulable overlapping constituents. The manipulable crotch area, in an unmanipulated state, can be maintained in a closed configuration by an interface of the overlapping constituents. The closed configuration can be alterable to an open configuration through separation of the overlapping constituents. The open configuration can be characterized by an opening aligned with the genitalia of the wearer. The urination device can be insertable into the opening and/or matable with the garment. When inserted, the overlapping constituents can form a seal around the urination device, thereby providing a secure interface between the garment and the urination device.

In some embodiments, a method for facilitating access to genitalia without removing a garment worn on a torso and a lower body of a wearer is disclosed. The garment can have a manipulable crotch area integrally defining manipulable overlapping constituents. The method can include separating the overlapping constituents of the garment to form an opening in the manipulable crotch area. The opening can be located at or near a lowermost portion of the manipulable crotch area and aligned with an anatomical location of a urethra of the wearer. The method can include inserting a urination device into the opening created by the separated overlapping constituents. The method can include releasing the overlapping constituents to enable the overlapping constituents to form a seal around the urination device, thereby providing a secure interface between the garment and the urination device and allowing the wearer to urinate without a need to remove the garment.

BRIEF DESCRIPTION OF THE DRAWINGS

The accompanying drawings, which are included to provide a further understanding of the disclosure and are incorporated in and constitute a part of this application, illustrate certain non-limiting embodiment(s) of the inventive concept. In the drawings.

DETAILED DESCRIPTION

In the following detailed description, numerous specific details are set forth in order to provide a thorough understanding of the inventive concept. However, it will be understood by those skilled in the art that the present inventive concept may be practiced without these specific details.

The present disclosure relates generally to clothing design and, more particularly, to a versatile garment facilitating easy access to the genitalia without requiring removal or significant lowering of the garment. This is achieved through the innovative design of a manipulable crotch area in the garment which, through manipulable overlapping constituents, creates an opening that aligns with the wearer's genitalia, thereby enhancing convenience and personal hygiene.

Traditional clothing design has often failed to address the inconvenience and discomfort faced by many individuals, of all genders, gender roles, gender identities, and expressions, during urination, particularly in situations where private facilities are inaccessible, inconvenient, or unsanitary. Often, the act of urination requires the removal or significant lowering of garments, leading to issues related to privacy, hygiene, and practicality.

In light of the above, there exists a need in the clothing industry for a garment that overcomes these disadvantages, particularly for individuals whose gender, gender role, gender identity, and/or gender expression is female, including transgender females. The garment described herein provides an innovative solution to this long-felt but unmet need, offering enhanced convenience and personal hygiene for a diverse range of individuals.

This disclosed garment simplifies the process of urination for females, providing a blend of comfort, convenience, and privacy. This garment can incorporate a manipulable crotch area that can be easily adjusted to permit urination while standing, sitting, or squatting, without the need to remove or lower the garment entirely. The area includes overlying materials that can be separated, creating an opening that allows the wearer to urinate without bodily exposure or concern about the urination stream affecting the garment. The manipulable crotch area maintains a closed position unless manually pulled open and the opening is achieved by adjusting the material, which is arranged in an overlapping pattern limited to the crotch area.

The features and advantages of the present inventive concept will be further appreciated upon consideration of the following detailed description of the inventive concept, along with the accompanying claims.

Figure 1:
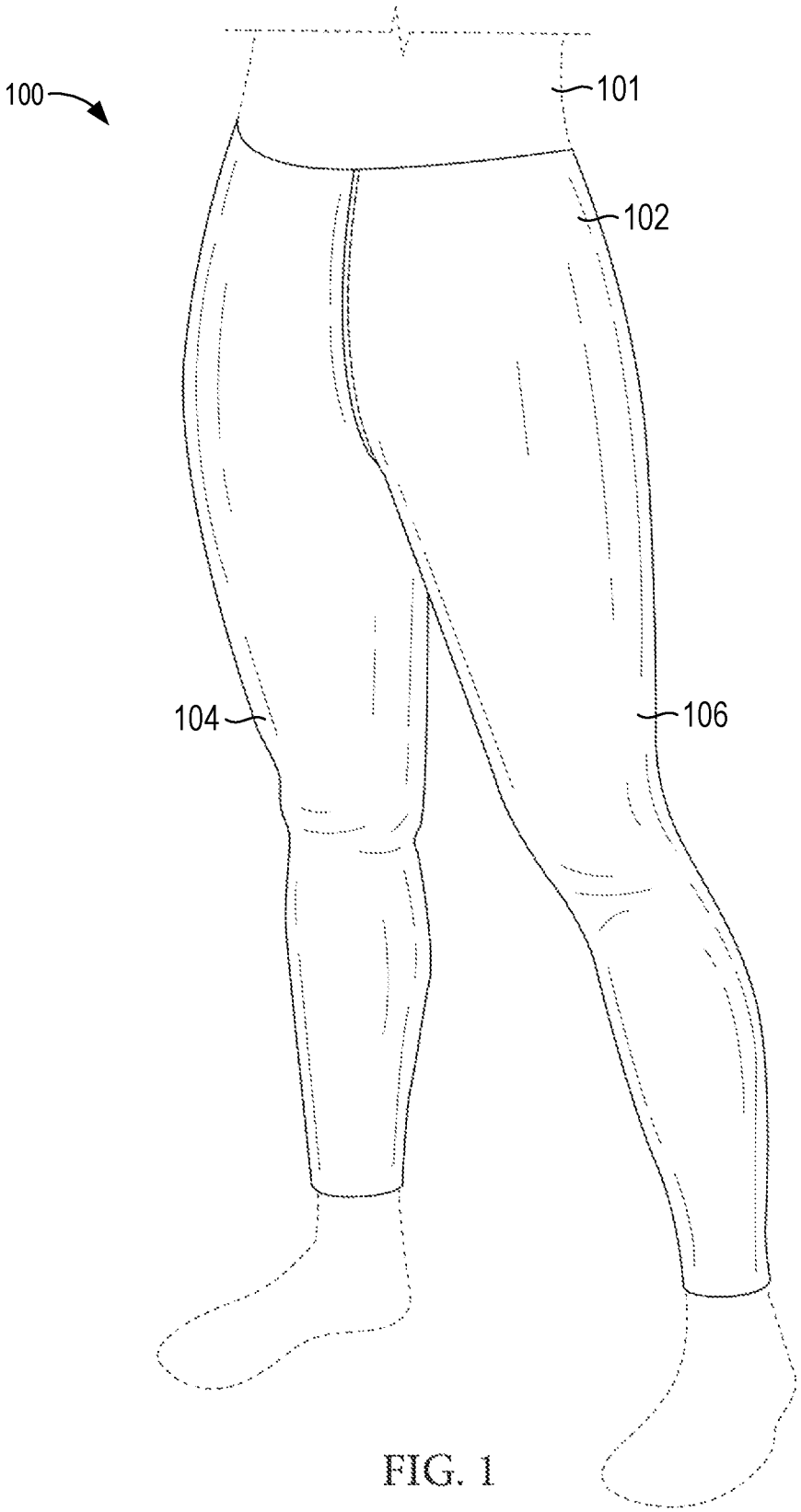
FIG. 1 illustrates a front perspective view of a garment in accordance with some embodiments of the present inventive concept.
Figure 2:
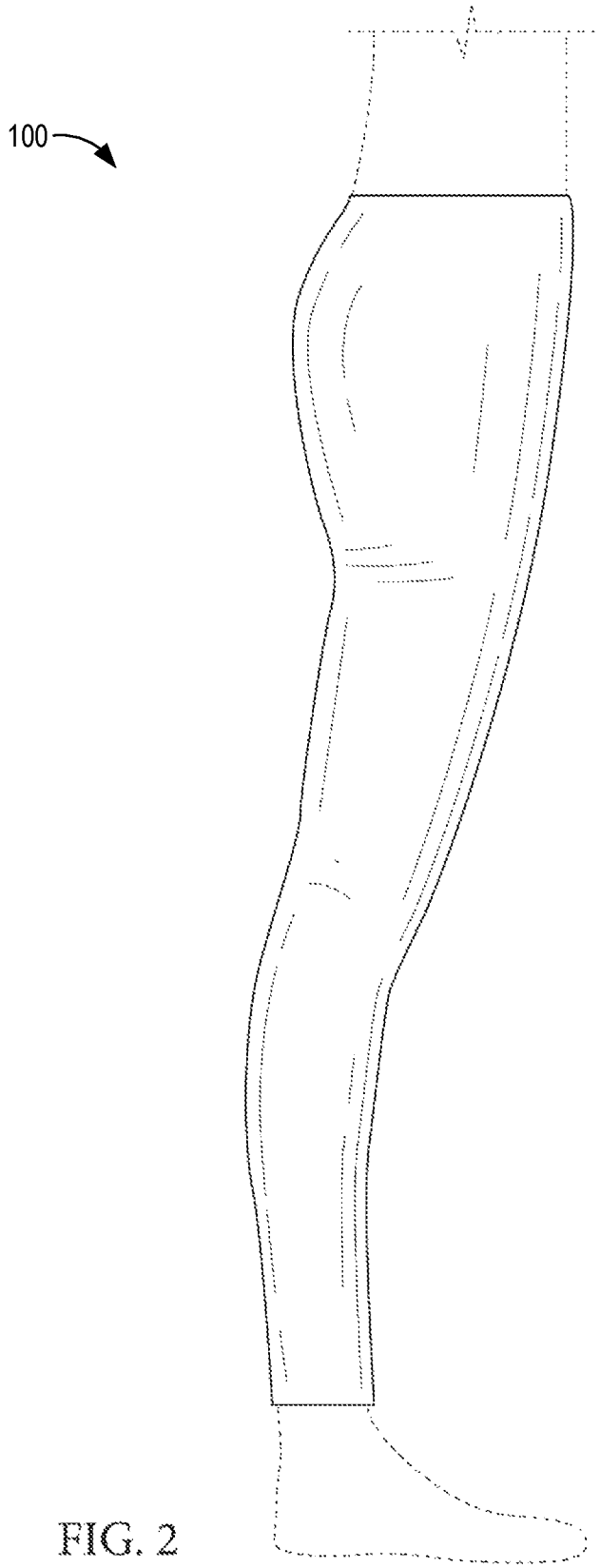
FIG. 2 illustrates a side view of the garment of FIG. 1.

FIG. 1 illustrates a front perspective view of a garment 100 in accordance with some embodiments of the present inventive concept. FIG. 2 illustrates a side view of the garment of FIG. 1. The garment 100 includes a body portion 102 adapted to be worn on a torso and a lower body of the wearer 101, along with two leg portions 104, 106 extending from the body portion 102, each specifically configured to accommodate a leg of the wearer 101. Each leg portion 104, 106 can extend contiguously from the body portion 102, showcasing the garment's continuous, integrated design.

Figure 3:
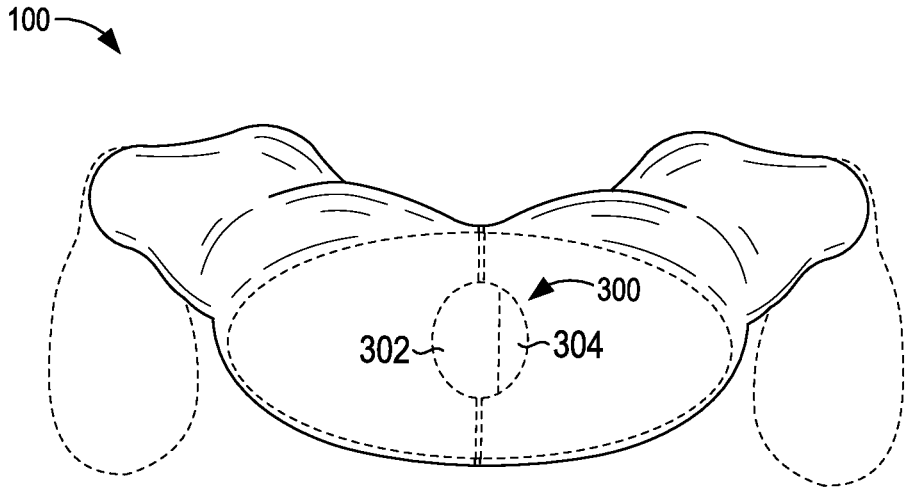
FIGS. 3 and 4 illustrate top and bottom views, respectively, of the garment of FIG. 1, showing the incorporation of an example manipulable crotch area in accordance with various embodiments of the present inventive concept.
Figure 4:
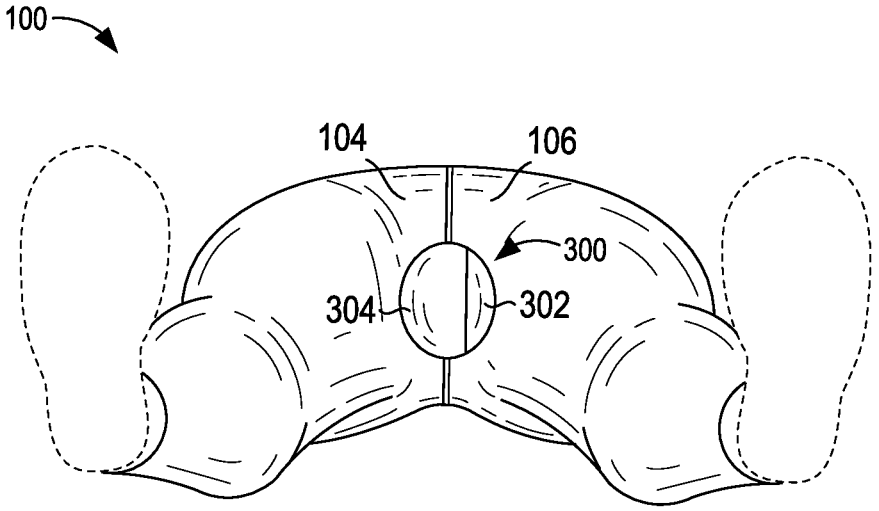

FIGS. 3 and 4 illustrate top and bottom views, respectively, of the garment of FIG. 1, showing the incorporation of a manipulable crotch area 300 in accordance with various embodiments of the present inventive concept. As shown, between the two leg portions 104, 106, a manipulable crotch area 300 is integrally formed, defined by the overlapping constituents 302, 304. This design advantageously facilitates access to genitalia of the wearer.

In an unmanipulated or resting state, the manipulable crotch area can maintain a closed configuration via the interface of the overlapping constituents 302, 304. An example closed configured is shown in FIG. 4. As discussed herein, the garment's design allows this closed configuration to be altered to an open configuration through separation of these overlapping constituents 302, 304, creating an opening (not shown) aligned with the genitalia of the wearer.

The constituents 302, 304 can be implemented as partially overlapping layers, where the constituent 302 functions as a first layer and constituent 304 serves as a second layer. In the unmanipulated state, each of these overlapping constituents 302, 304 can independently provide substantial coverage of the base layer's aperture. Notably, in various embodiments, each layer could cover 50%, 60%, 70%, 75% or more of the aperture's surface area in its unmanipulated state. This substantial coverage ensures complete or near-complete coverage of the aperture, reinforcing the structural design of the garment and enhancing its utility.

Moreover, when the garment is in a closed configuration, these constituents exhibit an interaction characterized by an overlap. In various embodiments, the overlapping constituents 302, 304 may overlap by 20%, 30%, 40%, 50%, 60%, 70%, or more of their total surface area.

In some embodiments, the manipulable crotch area 300 of the garment 100 may have a defined shape. In some embodiments, the shape may be a square, rectangle, circle, oval, triangle, etc. In particular embodiments, the shape may be circular or oval. In still other embodiments, the shape may have a limited width or diameter. In various embodiments, the perimeter of the manipulable crotch area 300 encompasses the genitalia or portion thereof. In other embodiments, the manipulable crotch area 300 of the garment 100 is configured to conform to the shape of the wearer's body. Conformity may be a snug, moderate or loose fit. In some embodiments, the conformity of the manipulable crotch area 300 of the garment is U-shaped when worn.

The overlapping constituents 302, 304 can be manipulated to create an opening (not shown) aligned with female genitalia. This opening can expose the urethra and/or vagina without the need for fasteners (e.g., snaps, buttons, zippers, ties, or other fasteners to maintain closure of the opening when closure is desired), offering a discreet exposure that upholds the wearer's privacy. Furthermore, in some cases, the design and placement of the overlapping constituents and their associated seams do not accentuate the genital outline.

In various embodiments, the overlapping constituents 302, 304 can be fabricated from the same or different material as the rest of the garment 100. Options include, but are not limited to, polyester, polyurethane (e.g., spandex), cotton, denim, linen, wool, silk, satin, rayon, leather, fleece, jersey, hemp, nylon, compacted woven or knit material, or a combination of these materials.

Some embodiments utilize stretch or elastic material, or material infused with stretch or elastic fibers, for the manipulable crotch area 300 and/or the overlapping constituents 302, 304. This elasticity allows the material to stretch and generate an opening at least 25%, 50%, 75%, or 100% larger than the unmanipulated state, thereby enabling the wearer to expose the desired anatomy.

In some designs, the material forming the manipulable crotch area 300, including the overlapping materials and/or material surrounding the area, can be lined with a material capable of absorbing and/or wicking away moisture. This liner can serve as an additional shield, preventing bodily fluids from coming into contact with the garment's fabric or the wearer's skin.

Figure 5:
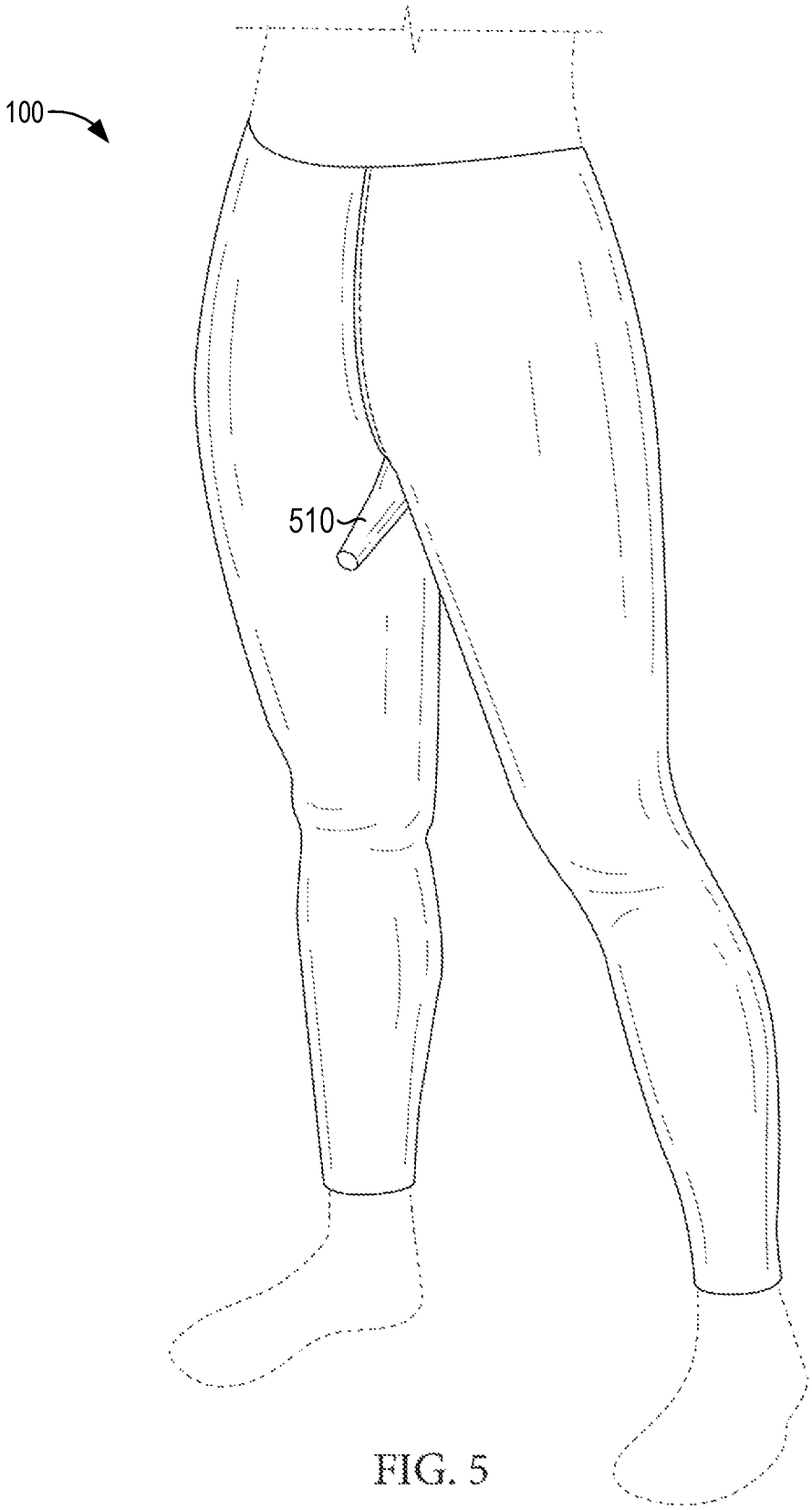
FIG. 5 is a front perspective environmental view of the garment of FIG. 1, shown with an example urination device in accordance with various embodiments of the present inventive concept.

FIG. 5 is a front perspective environmental view of the garment 100 of FIG. 1, demonstrating the garment's interaction with an illustrative urination device 510. In some cases, the urination device 510 is specifically designed to interface compatibly with the manipulable crotch area 300. This compatibility can be achieved through a design feature that allows the urination device 510 to be securely nestled within the manipulable crotch area 300.

The overlapping constituents 302, 304, for example due to their resilient nature, can be capable of flexibly adapting to the shape and contours of the urination device 510. Upon the manipulable crotch area 300 being manipulated into to an open configuration and the urination device 510 being inserted into the resulting aperture, the overlapping constituents 302, 304 can envelop the urination device 510, holding it securely in place. The seal formed by the manipulable crotch area 300 can provide a reliable grip on the urination device, minimizing the risk of accidental displacement. As such, the design ensures a stable and secure attachment between the garment and the urination device 510, facilitating ease of use and promoting user confidence.

The urination device 510 can include any urination aids such as urination funnels, suitable receptacles like beverage or water bottles, external urine collection devices (EUCD), or urinary catheters.

In some cases, the garment 100 can be worn with or without an undergarment. When used with an undergarment, the manipulable crotch area 300 of the garment 100 can be moved aside to allow the wearer to urinate without removing any clothing and/or significantly exposing the genitalia.

Figure 6:
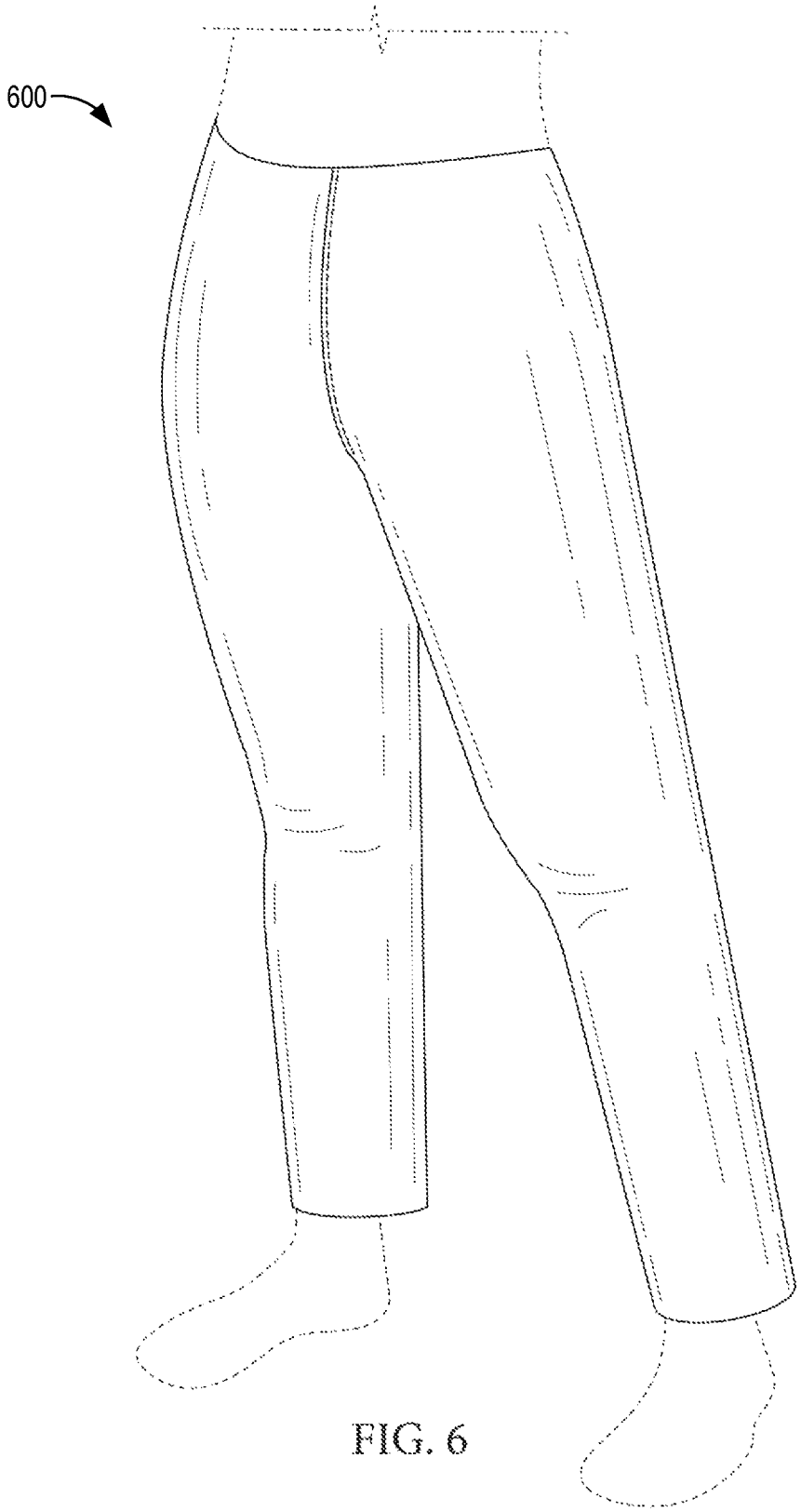
FIG. 6 illustrates a front perspective view of a garment in accordance with some embodiments of the present inventive concept.
Figure 7:
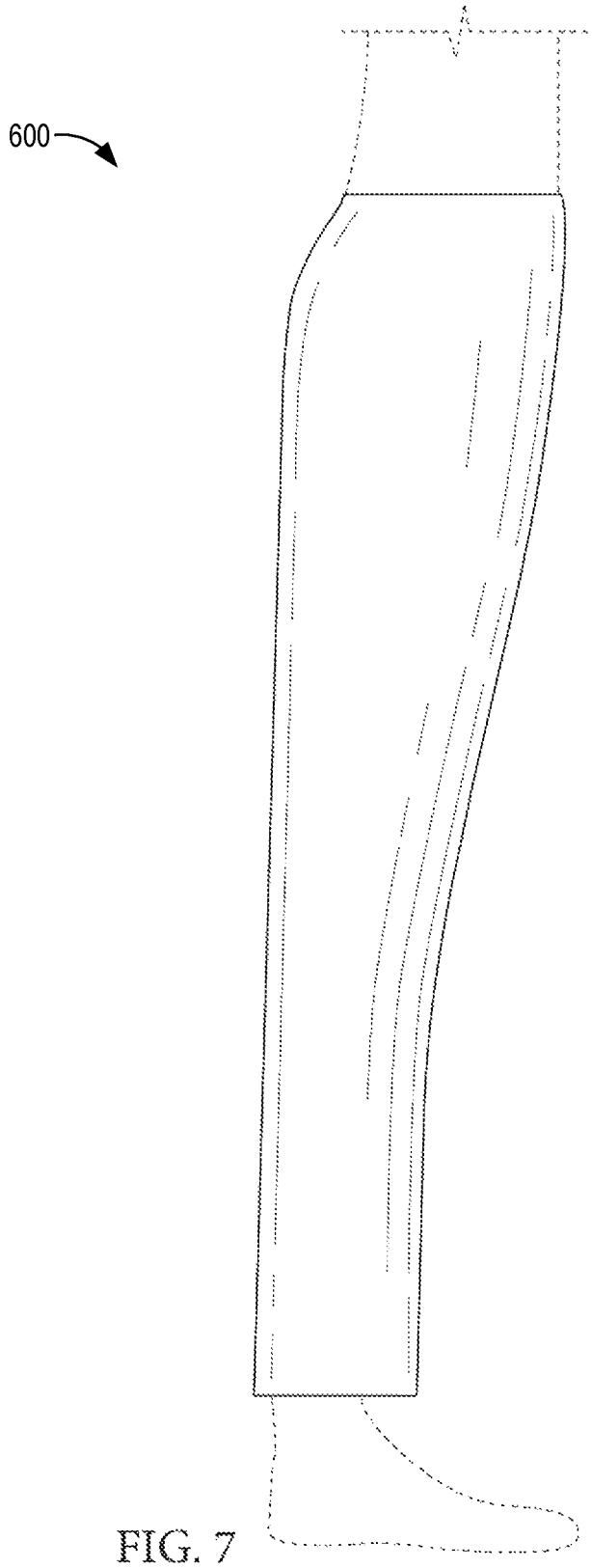
FIG. 7 illustrates a side view of the garment of FIG. 6.

FIG. 6 illustrates a front perspective view of a garment 600 in accordance with some embodiments of the present inventive concept. FIG. 7 illustrates a side view of the garment of FIG. 6. The garment 600 may be an embodiment of the garment 100 of FIG. 1. FIG. 6 demonstrates additional design variations. For example, as compared to the garment 100 of FIG. 1, the garment 600 of FIG. 6 has a looser, more relaxed fit.

Figure 8:
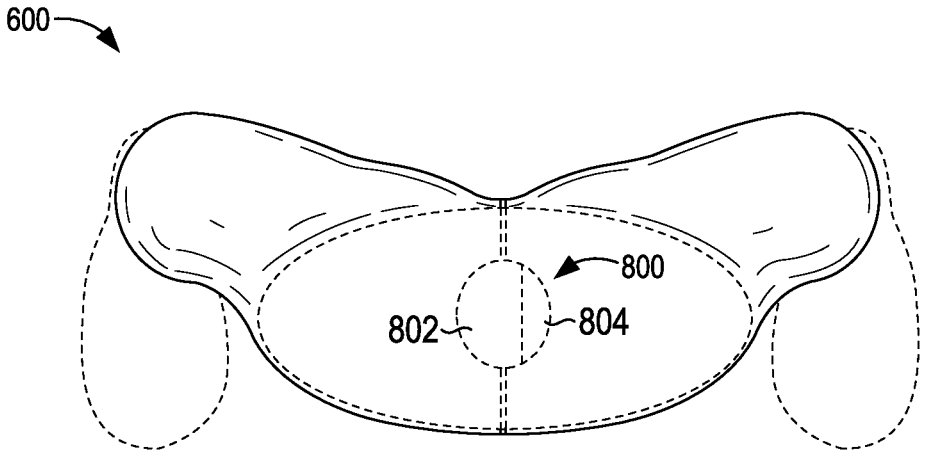
FIGS. 8 and 9 illustrate top and bottom views, respectively, of the garment of FIG. 6, showing the incorporation of a manipulable crotch area in accordance with various embodiments of the present inventive concept.
Figure 9:
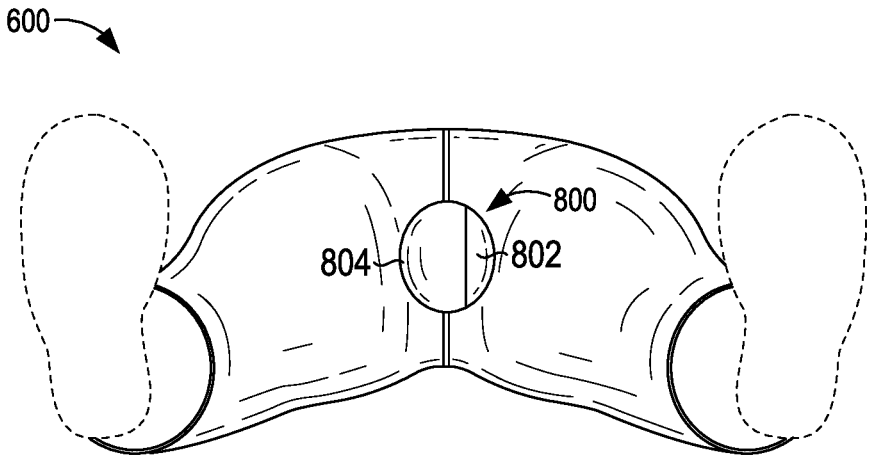

FIGS. 8 and 9 illustrate top and bottom views, respectively, of the garment 600 of FIG. 6, showing the incorporation of a manipulable crotch area 800 in accordance with various embodiments of the present inventive concept. The manipulable crotch area 800 can be an embodiment of the manipulable crotch area 300. For example, the manipulable crotch area 800 can include overlapping constituents 802, 804.

Figure 10:
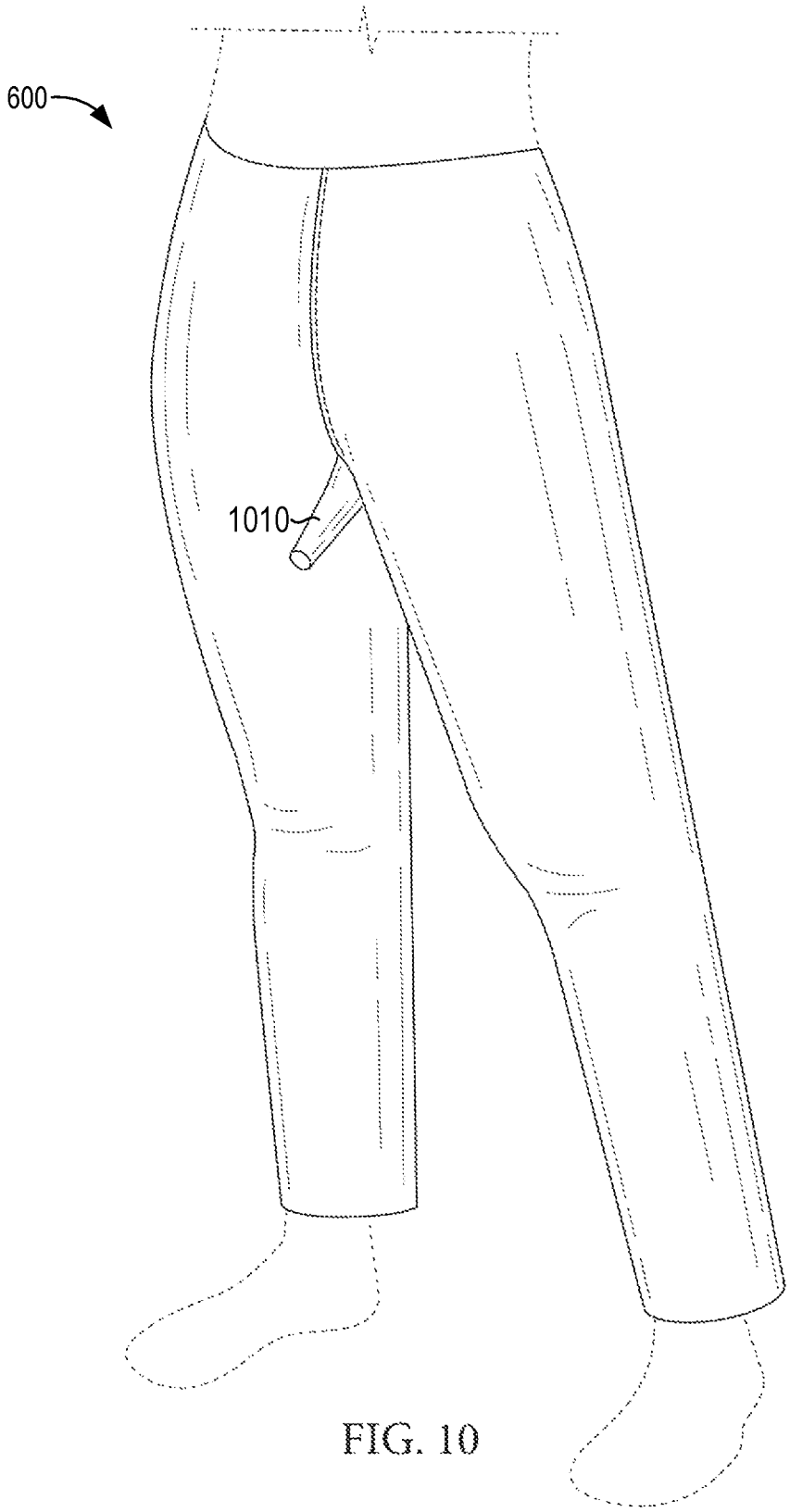
FIG. 10 is a front perspective environmental view of the garment of FIG. 6, shown with an example urination device in accordance with various embodiments of the present inventive concept.

FIG. 10 is a front perspective environmental view of the garment 600 of FIG. 6, shown with an example urination device 1010 in accordance with various embodiments of the present inventive concept. The urination device 1010 may interface with the manipulable crotch area 800, similar to as described herein with regard to the urination device 510 of FIG. 5.

Figure 11:
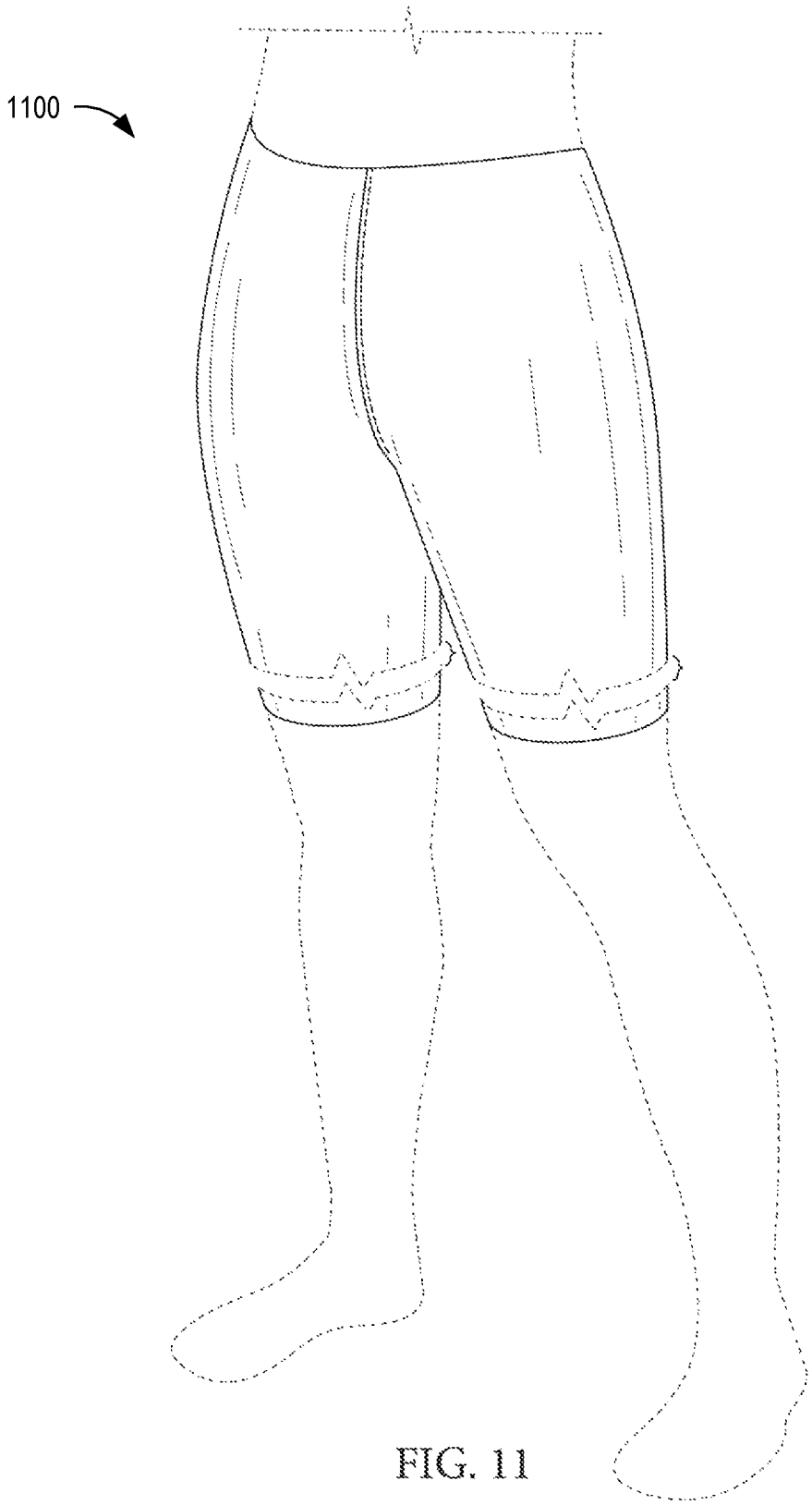
FIG. 11 illustrates a front perspective view of a garment in accordance with some embodiments of the present inventive concept.
Figure 12:
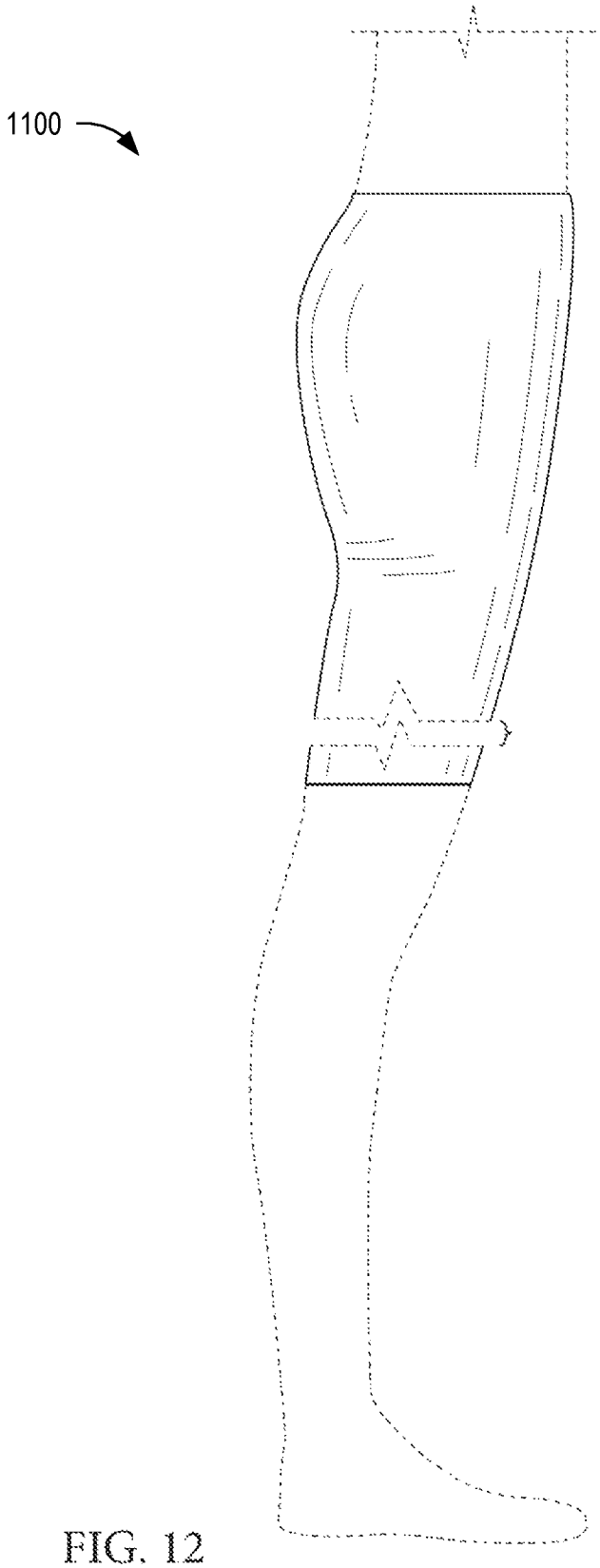
FIG. 12 illustrates a side view of the garment of FIG. 11.
Figure 13:
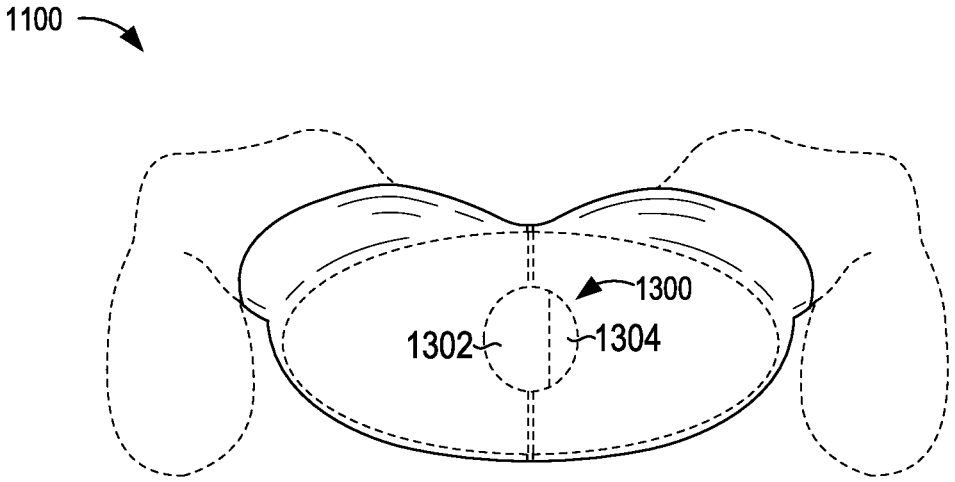
FIGS. 13 and 14 illustrate top and bottom views, respectively, of the garment of FIG. 11, showing the incorporation of a manipulable crotch area in accordance with various embodiments of the present inventive concept.
Figure 14:
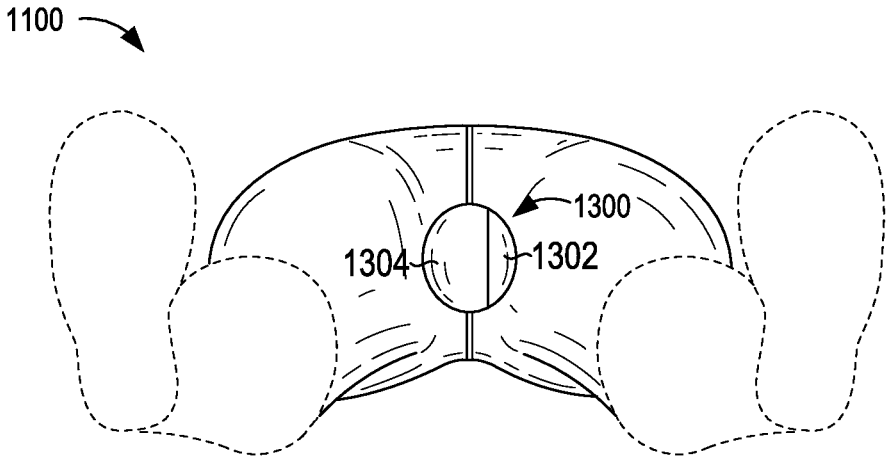

FIGS. 11-14 illustrate front perspective, side, top, and bottom views of a garment 1100 in accordance with some embodiments of the present inventive concept. The garment 1100 may be an embodiment of the garment 100 of FIG. 1. FIG. 11 demonstrates additional design variations of the garment. For example, as compared to the garment 100 of FIG. 1, the garment 600 of FIG. 11 has shorter legs (e.g. shorts).

The garment can be of any length and can serve various uses. For instance, it could be an article of clothing such as pants, jeans, jeggings, leggings, tights, hosiery, athletic pants, sweatpants, camouflage pants, leisure pants, yoga pants, one-piece suits, bibs, pajama pants, medical scrub pants, shorts, running shorts, skorts, swimwear, and so forth. The garment can be worn during recreational activities, professional scenarios, during travel, or by individuals suffering from urinary incontinence. Its convenience and design may also aid those who require caregiver assistance for urination, including older adults or those who use urinary catheters.

Figure 15:
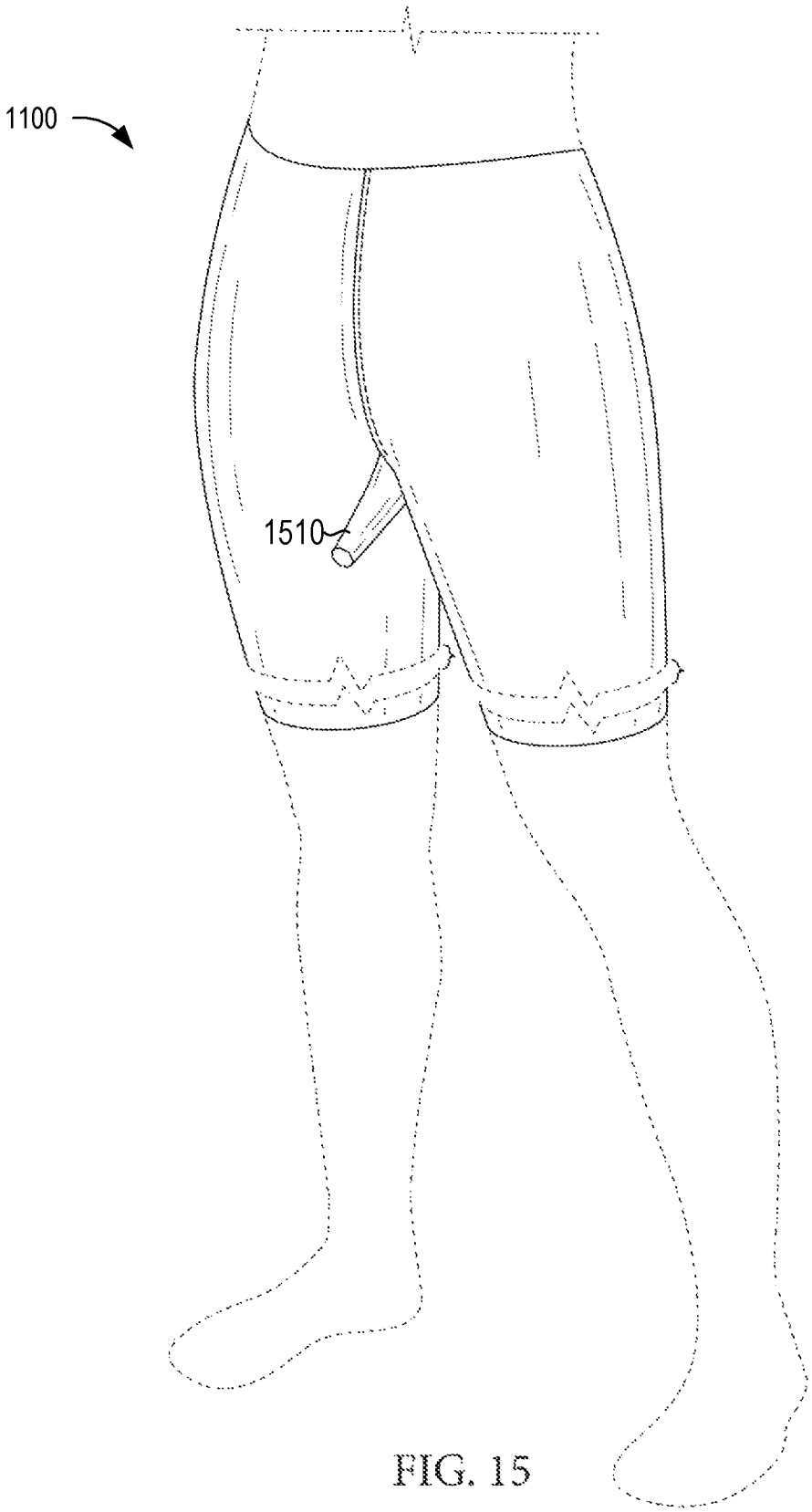
FIG. 15 is a front perspective environmental view of the garment of FIG. 11, shown with an example urination device in accordance with various embodiments of the present inventive concept.

FIG. 15 is a front perspective environmental view of the garment of FIG. 11, shown with an example urination device in accordance with various embodiments of the present inventive concept. The urination device 1510 may interface with the manipulable crotch area 800, similar to as described herein with regard to the urination device 510 of FIG. 5.

Figure 16:
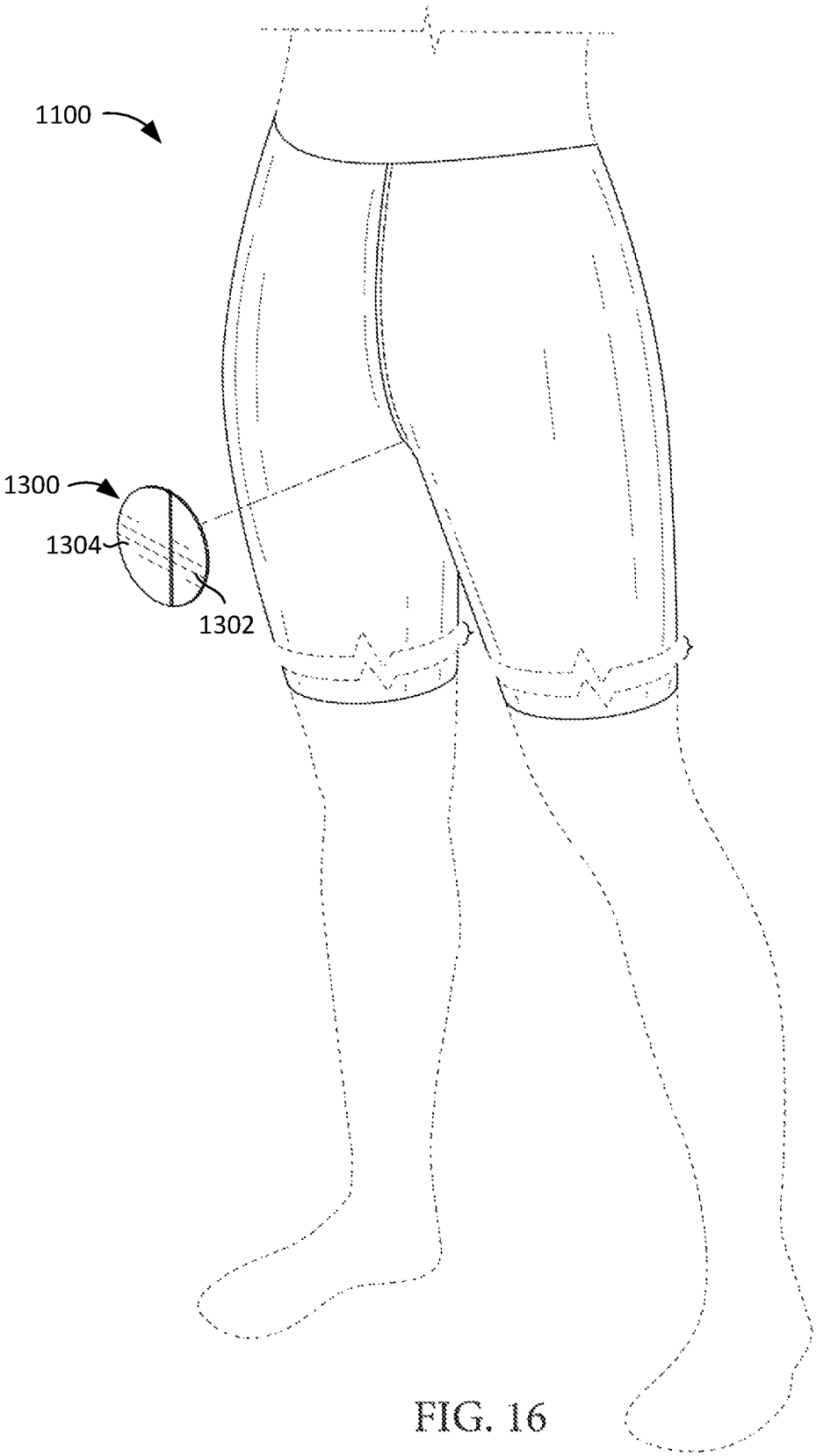
FIG. 16 illustrates a front perspective view of the garment of FIG. 11 and also illustrates an enlarged partial bottom view of the manipulable crotch area in the closed configuration.

FIG. 16 illustrates a front perspective view of the garment of FIG. 11 and also illustrates an enlarged partial bottom view of the manipulable crotch area 1300 in the closed configuration. As shown, due to the constituents 1302, 1304 and their overlapping configuration when in a closed state, privacy is maintained.

Figure 17:
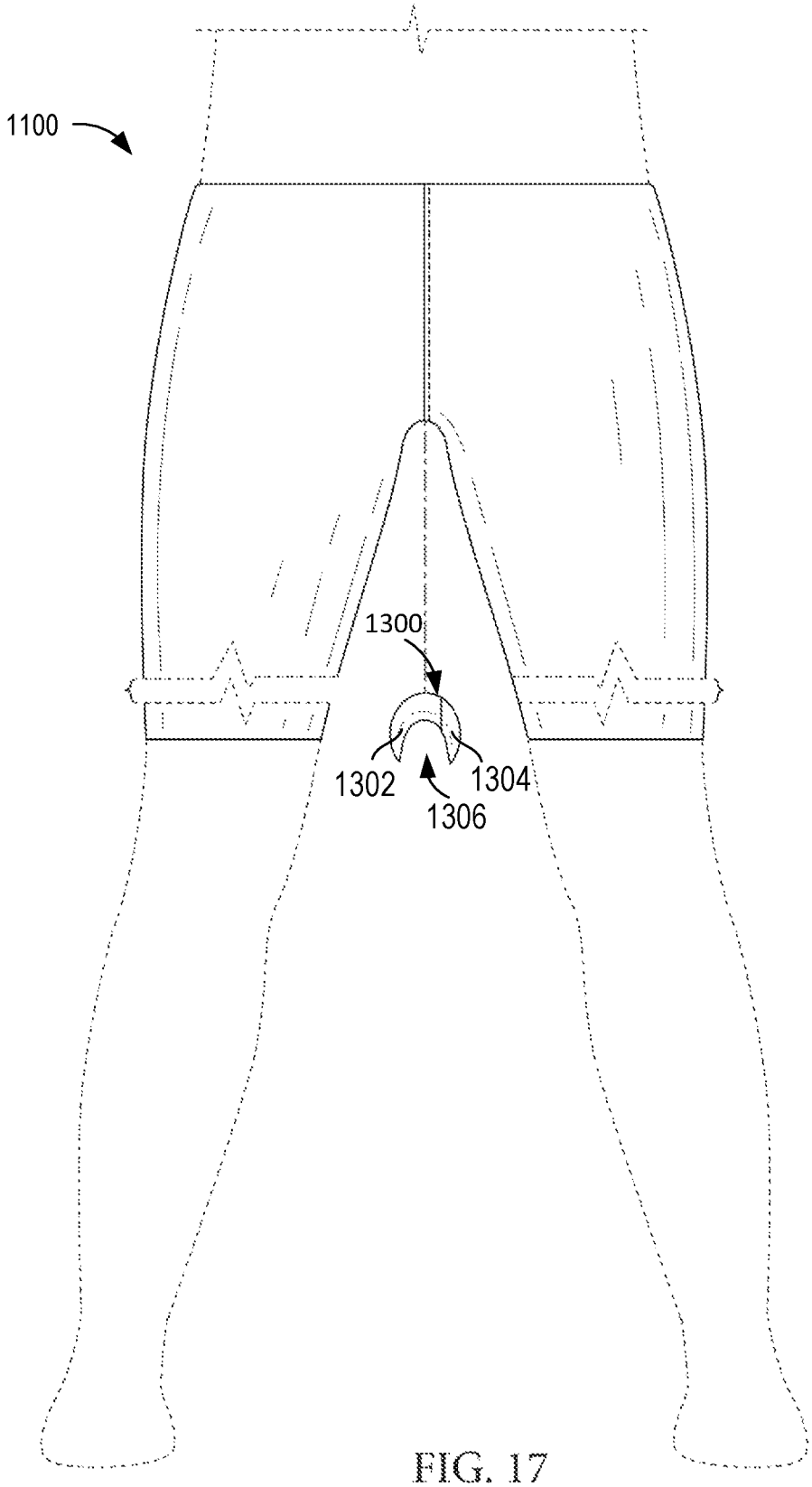
FIG. 17 illustrates a back perspective view of the garment of FIG. 11 and also illustrates an enlarged partial bottom view of the manipulable crotch area in the open configuration.

FIG. 17 illustrates a back perspective view of the garment of FIG. 11 and also illustrates an enlarged partial bottom view of the manipulable crotch area 1300 in an open configuration. The design of this manipulable crotch area 1300 is characterized by constituents 1302 and 1304, which, in the open state, exhibit at least a partial separation. This separation gives rise to an opening or a gap, which can generally be referred to as aperture 1306. As such, the dimensions of the aperture 1306 are not fixed, but are instead variable, contingent upon the degree of separation of the constituents 1302 and 1304. This demonstrates the dynamic nature of the garment's design, where the size of aperture 1306 can be adjusted to accommodate various requirements, spanning from minor to substantial separation of the constituents 1302, 1304, thereby providing flexible access to the genitalia of the wearer as and when needed.

Figure 18:
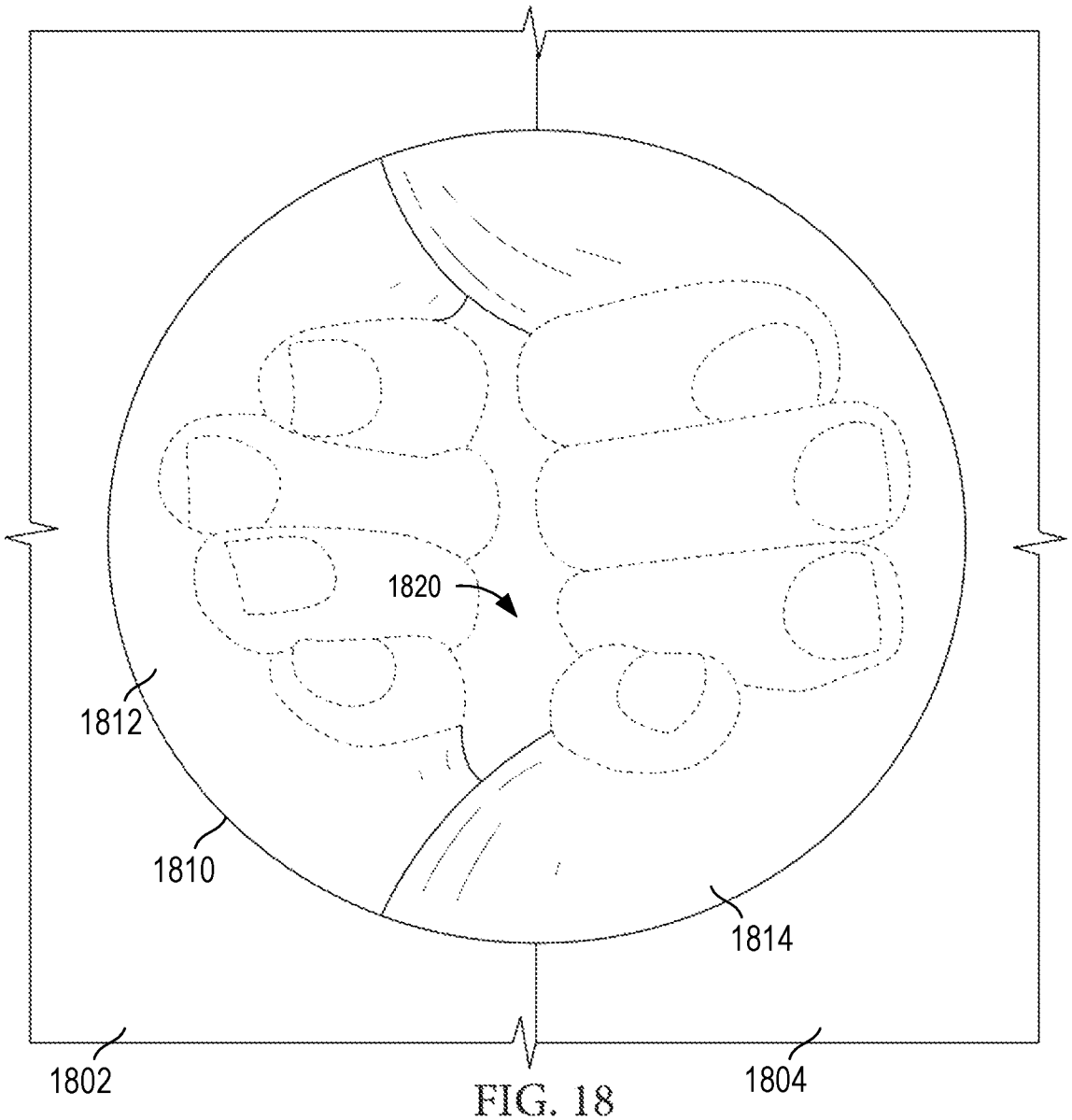
FIG. 18 illustrates an enlarged bottom view of an example garment with a manipulable crotch area, demonstrating a partially open configuration of the manipulable crotch area in response to a wearer's hands spreading the opening.

FIG. 18 illustrates an enlarged bottom view of an example garment with a manipulable crotch area 1810, demonstrating a partially open configuration of the manipulable crotch area 1810 enabled by the active intervention of the wearer's hands to create an aperture 1820. Within the manipulable crotch area 1810, two prominent constituents can be observed: the first layer or constituent 1812, and the second layer or constituent 1814. The unique arrangement of these two layers facilitates the opening and closing mechanism that can be central to the garment's functionality.

The garment further includes fabric 1802, 1804, which constitutes the material outside of the manipulable crotch area 1810. The fabric 1802, 1804 serves to provide the garment with its structure and overall aesthetic, but also plays a role in maintaining the positioning and orientation of the crotch area 1810 and its constituent layers 1812, 1814.

As discussed herein, the aperture 1820 is a space created by the separation of constituents 1302 and 1304. This aperture 1820 emerges when the wearer's hands spread the layers apart, transitioning the crotch area 1810 from its closed configuration to a partially open one. The precise size and shape of the aperture 1820 can vary, depending on the extent to which the layers 1812, 1814 are separated, thereby offering wearer-controlled adjustability for tailored use scenarios.

Figure 19:
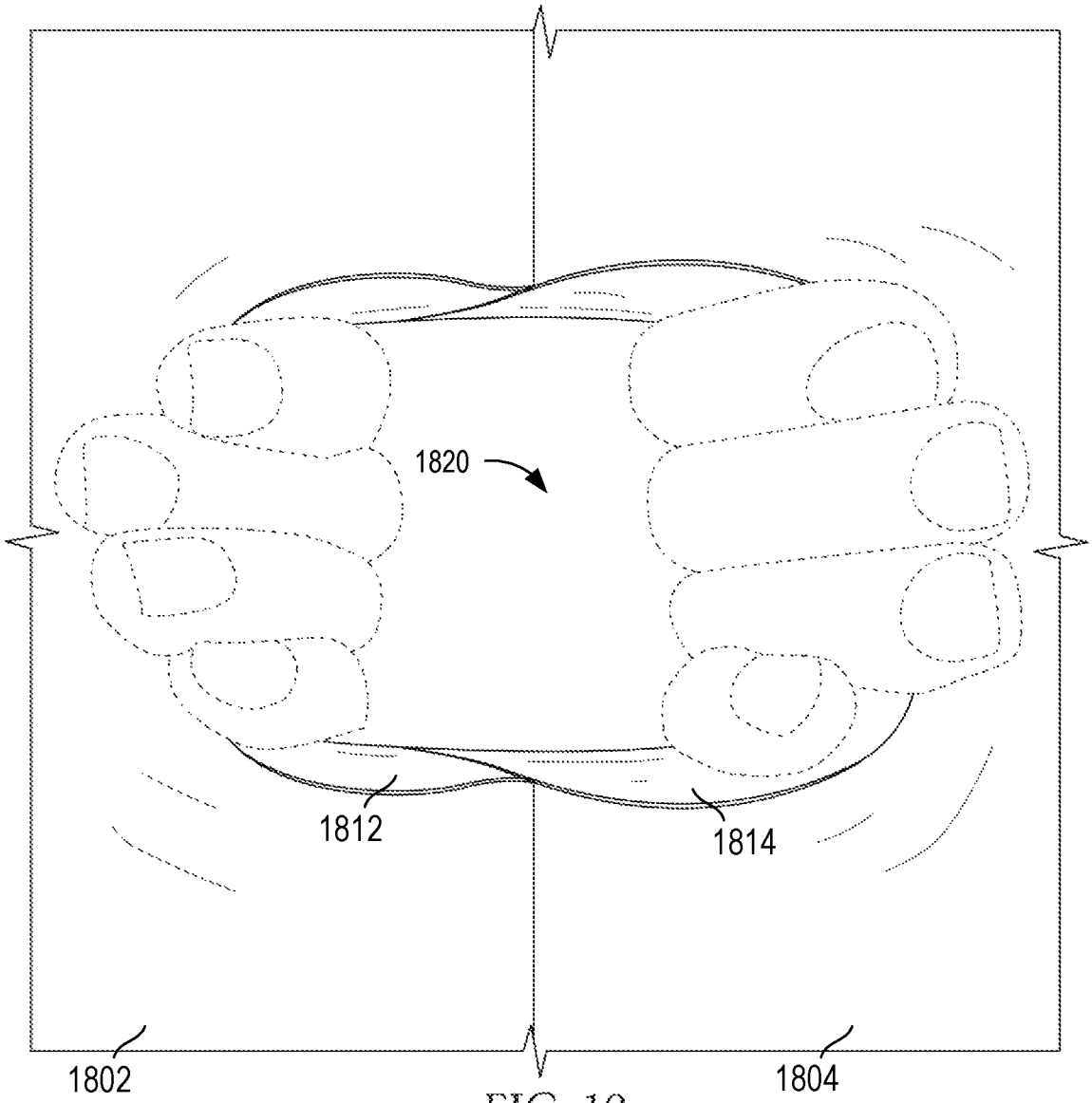
FIG. 19 illustrates an enlarged bottom view of an example garment with a manipulable crotch area, demonstrating a fully open configuration of the manipulable crotch area in response to a wearer's hands spreading the opening.

FIG. 19 illustrates an enlarged bottom view of an example garment with a manipulable crotch area, demonstrating a fully open configuration of the manipulable crotch area in response to a wearer's hands spreading the opening. This state is realized when a wearer's hands actively spread apart the overlapping constituents 1812, 1814, thereby widening the aperture 1820. As opposed to the partially open configuration as seen in FIG. 18, FIG. 19 showcases the manipulable crotch area 1810 in its fully open state. This figure encapsulates the process of separating the overlapping constituents 1812, 1814 of the garment to form an opening in the manipulable crotch area 1810.

Figure 20:
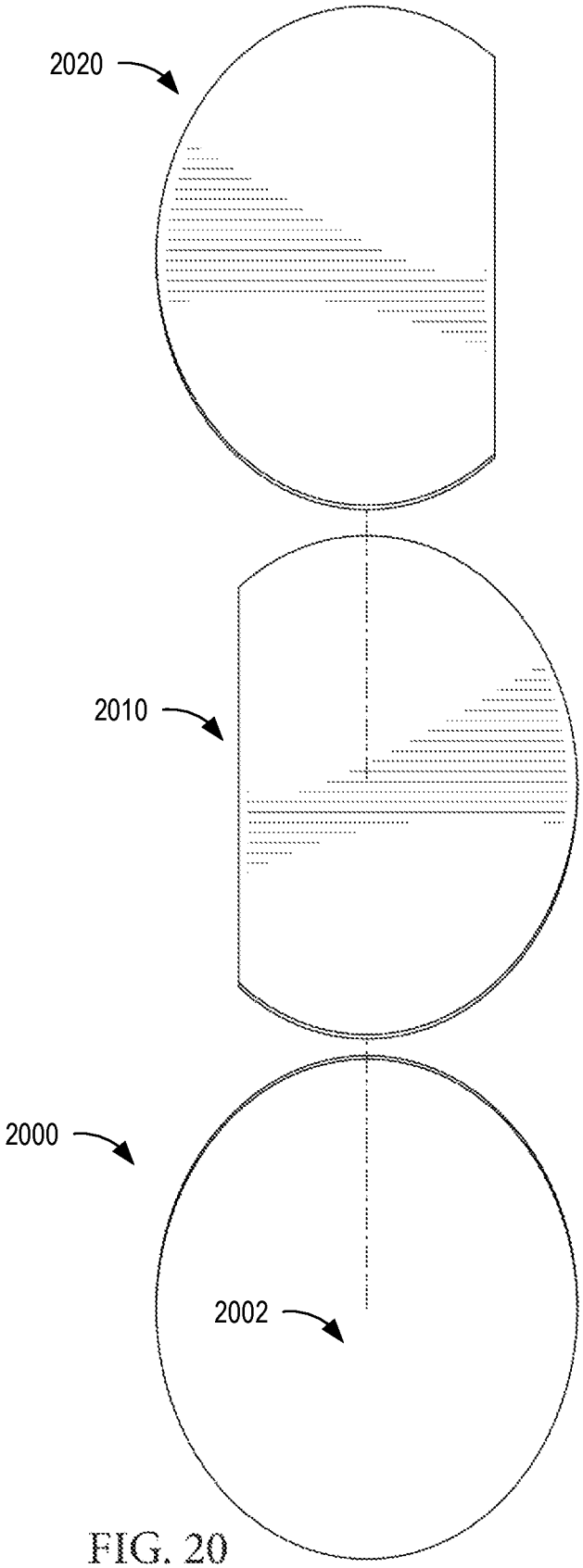
FIG. 20 is an exploded view of the manipulable crotch area showing the overlapping material.

FIG. 20 illustrates an exploded view of a manipulable crotch area, detailing the overlapping constituents 2010, 2020 and their arrangement. The manipulable crotch area includes a base layer 2000 defining an aperture 2002. The base layer 2000 can form a primary support structure where the overlapping constituents are positioned. The base layer 2000 and/or the aperture 2002 of the base layer 2000 can have a geometric shape selected from the group consisting of: circular, elliptical, square, rectangle, triangle, or pentagon, among others.

The manipulable crotch area also includes a first layer 2010 and a second layer 2020. The first layer 2010 is positioned to cover a portion of the aperture 2002 of the base layer 2000. The second layer 2020 is designed to overlap the first layer 2010 and effectively covers any part of the aperture 2002 that may remain exposed by the first layer 2010. This specific arrangement ensures that in the unmanipulated state, the first layer 2010 and second layer 2020 collectively cover the entirety of the aperture 2002.

Furthermore, the first layer 2010 and the second layer 2020 are independently manipulable. This allows the wearer to adjust and expose the aperture 2002 of the base layer 2000 when necessary, providing direct access to their genitalia through the aperture 2002, thereby improving the garment's practicality and convenience of use.

Figure 21:
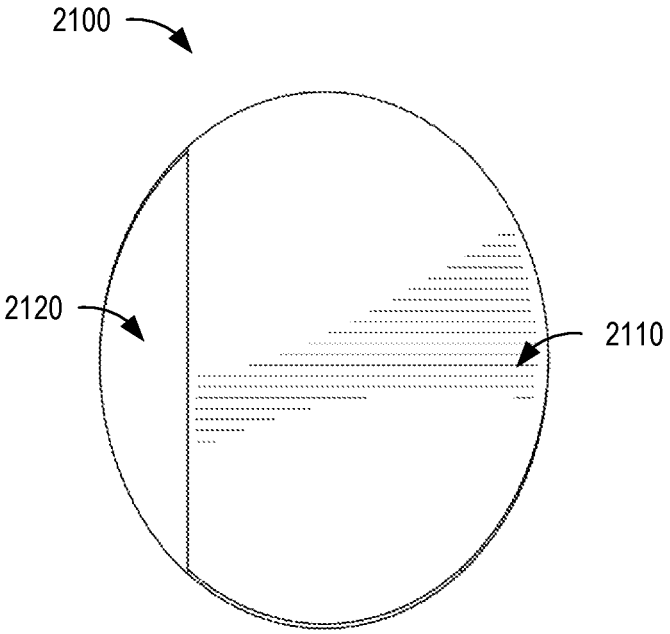
FIG. 21 is an enlarged front view of the manipulable crotch area having the overlapping material.
Figure 22:
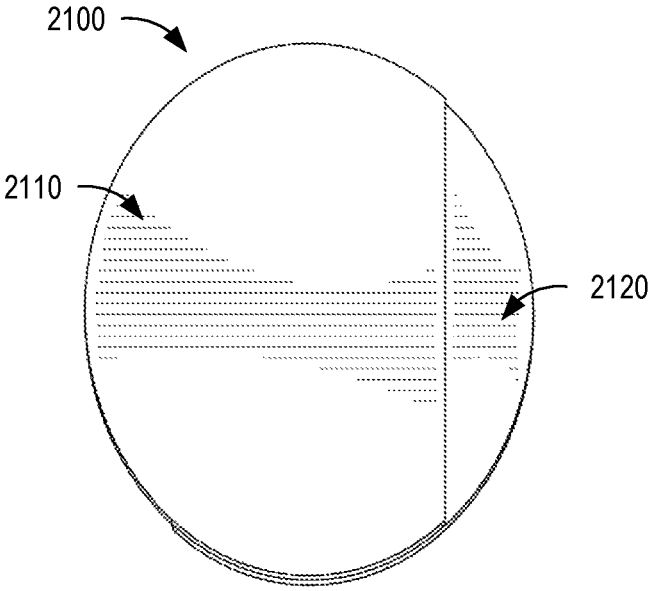
FIG. 22 is a rear view of the manipulable crotch area having the overlapping material.

FIGS. 21 and 22 are enlarged front and rears views, respectively, of an example manipulable crotch area 2100 in accordance with various embodiments of the present inventive concept.

In the embodiments disclosed herein, the garment generally features two overlapping constituents in the manipulable crotch area. However, it should be noted that the use of only two overlapping constituents is for illustrative purposes, and the inventive concept contemplates the incorporation of any number of overlapping constituents. For instance, while two overlapping constituents are shown and described, additional overlapping constituents can be introduced to enhance the functionality and design flexibility of the garment. By incorporating more overlapping constituents, the opening created by their separation can be further customized in terms of size, shape, and alignment with the wearer's genitalia.

The inclusion of multiple overlapping constituents allows for variations in the structural configuration of the manipulable crotch area. This enables the garment to accommodate different body shapes and sizes while maintaining comfort and functionality. Moreover, the use of additional overlapping constituents can provide increased stability and support to the manipulable crotch area. This ensures that the garment maintains its intended form during use and facilitates seamless transitions between the closed and open configurations. Therefore, while the disclosed embodiments illustrate two overlapping constituents, it is understood that the inventive concept is not limited thereto, and any number of overlapping constituents may be employed to achieve the desired functionality, adaptability, and user experience.

Terminology

A wide range of embodiments of this inventive concept, each with varying design and functionality, have been presented through the accompanying illustrations. However, the concept is not restricted to the described embodiments; instead, they provide a thorough and comprehensive disclosure that fully conveys the scope of this innovative concept to those skilled in the art.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. Well-known functions or constructions may not be described in detail for brevity and/or clarity.

Further, it will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concept. Moreover, as used herein, the term "and/or" includes any and all combinations of one or more of the associated listed items.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

As used herein, the terms "can include", "comprising", "can includes", "include", "including", "includes", "have", "has", "having", or variants thereof are open-ended, and include one or more stated features, integers, elements, steps, components, or functions but does not preclude the presence or addition of one or more other features, integers, elements, steps, components, functions, or groups thereof. Furthermore, if used herein, the common abbreviation "e.g.", which derives from the Latin phrase exempli gratia, may be used to introduce, or specify a general example or examples of a previously mentioned item, and is not intended to be limiting of such item. If used herein, the common abbreviation "i.e.", which derives from the Latin phrase id est, may be used to specify a particular item from a more general recitation.

Many different embodiments were disclosed herein, in connection with the description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support Claims to any such combination or subcombination.

In the specification, there have been disclosed embodiments of the inventive concept and, although specific terms are used, they are used in a generic and descriptive sense only and not for purposes of limitation. The following Claim is provided to ensure that the present application meets all statutory requirements as a priority application in all jurisdictions and shall be construed as setting forth the scope of the present inventive concept.

That which is claimed is:

1. A garment for facilitating access to genitalia of a wearer, the garment comprising:

a body portion adapted to be worn on a torso and a lower body of the wearer;

two leg portions extending from the body portion, each leg portion configured to accommodate a leg of the wearer; and a manipulable crotch area integrally formed between the two leg portions, the manipulable crotch area defined by manipulable overlapping constituents, wherein the manipulable crotch area, in an unmanipulated state, is maintained in a closed configuration by an interface of the overlapping constituents, and wherein the closed configuration is alterable to an open configuration through separation of the overlapping constituents, the open configuration characterized by an opening aligned with the genitalia of the wearer, wherein the manipulable crotch area comprises a base layer defining an aperture and wherein the overlapping constituents are independently manipulable to expose the aperture of the base layer; and wherein the aperture of the base layer has a defined geometric shape that is bound by a front seam and a back seam of the garment further defining the geometric shape of the aperture selected from the group consisting of: circular, elliptical, square, rectangle, triangle, and pentagon.

2. The garment of claim 1, wherein the overlapping constituents comprises first and second overlapping panels, the first and second overlapping panels being arranged such that manipulation in a lateral direction or a downward direction results in creation of the opening.

3. The garment of claim 1, wherein the manipulable crotch area, when in the open configuration, allows for direct access to the genitalia for urination without removal or significant lowering of the garment.

4. The garment of claim 1, wherein the overlapping constituents comprises first and second overlapping panels, the first and second overlapping panels being arranged such that manipulation in a lateral direction or a downward direction results in creation of the opening.

5. The garment of claim 1, wherein the opening is located proximate a lowermost portion of the manipulable crotch area when the garment is worn.

6. The garment of claim 1, wherein the manipulable crotch area is located at a position corresponding to an anatomical location of a urethra of the wearer when the garment is worn.

7. The garment of claim 1, wherein each leg portion extends contiguously from the body portion.

8. The garment of claim 1, wherein the garment is selected from the group consisting of pants, jeans, jeggings, leggings, tights, hosiery, athletic pants, sweatpants, leisure pants, yoga pants, one-piece suits, bibs, pajama pants, medical scrub pants, shorts, running shorts, skorts, and swimwear.

9. The garment of claim 1, wherein the garment is suitable for use by human subjects of any gender, gender role, gender identity and/or gender expression.

10. The garment of claim 1, wherein the garment is configured to be used with or without an undergarment.

11. The garment of claim 1, wherein the interface is located proximate a lower part of the manipulable crotch area when worn by the wearer.

12. A method for facilitating access to genitalia without removing a garment worn on a torso and a lower body of a wearer, the garment having a manipulable crotch area integrally defining manipulable overlapping constituents, the method comprising:

separating the overlapping constituents of the garment to form an opening of a defined shape in the manipulable crotch area, wherein the opening is located at or near a lowermost portion of the manipulable crotch area and aligned with an anatomical location of a urethra of the wearer wherein the opening has a defined geometric shape that is bound by a front seam and a back seam of the garment further defining the geometric shape of the opening;

inserting a urination device into the opening created by the separated overlapping constituents providing a secure interface between the garment and the urination device and allowing the wearer to urinate without a need to remove the garment.

13. A garment for facilitating access to genitalia of a wearer, the garment comprising:

a body portion adapted to be worn on a torso and a lower body of the wearer;

two leg portions extending from the body portion, each leg portion configured to accommodate a leg of the wearer; and a manipulable crotch area integrally formed between the two leg portions, the manipulable crotch area defined by manipulable overlapping constituents, wherein the manipulable crotch area, in an unmanipulated state, is maintained in a closed configuration by an interface of the overlapping constituents, and wherein the closed configuration is alterable to an open configuration through separation of the overlapping constituents, the open configuration characterized by an opening aligned with the genitalia of the wearer, wherein the manipulable crotch area comprises a base layer defining an aperture and wherein the overlapping constituents are independently manipulable to expose the aperture of the base layer; and wherein the aperture of the base layer has a defined geometric shape that is bound by a seam that extends to the waistband from the aperture on opposite sides of the garment.

* * * * *